United States Patent [19]

Bryant et al.

[11] 4,069,775

[45] Jan. 24, 1978

[54] YARN TENSION COMPENSATING MECHANISM

[75] Inventors: Clifford Aldene Bryant; Mark Floyd Jarrell, both of Dalton, Ga.

[73] Assignee: West Point-Pepperell, Inc., West Point, Ga.

[21] Appl. No.: 718,572

[22] Filed: Aug. 30, 1976

[51] Int. Cl.[2] ..... D05C 15/26

[52] U.S. Cl. ..... 112/79 A; 34/52; 68/20; 226/114

[58] Field of Search ..... 112/79 A, 79 R, 79.5, 112/218 R; 68/20; 34/152, 56, 155, 52; 226/114, 113; 57/58.91; 242/58

[56] References Cited

U.S. PATENT DOCUMENTS

| | | | |
|---|---|---|---|
| 1,990,907 | 2/1935 | Kellogg | 112/218 R X |
| 3,515,327 | 6/1970 | Bortmas | 226/113 |
| 3,623,440 | 11/1971 | Spedding et al. | 112/79 A |
| 3,687,348 | 8/1972 | Scheib | 226/113 |
| 3,698,611 | 10/1972 | Twine | 226/114 X |

*Primary Examiner*—H. Hampton Hunter

*Attorney, Agent, or Firm*—Davis, Hoxie, Faithfull & Hapgood

[57] ABSTRACT

The invention provides a roll over which a sheet of dyed and dried yarns passes from a drying chamber. During operation of the apparatus, the roll is maintained in a position diverting the yarns out of a straight path, creating a surplus in the path. When the machine stops, the roll is moved slowly under controlled conditions to a position nearer a straight path, during which the surplus is given up to compensate for the shrinkage of the yarn residing in the drying chamber whereby yarn in the dyeing stage remains motionless. The invention is particularly (but not solely) useful in the manufacture of tufted carpeting from yarns dyed individually in segments along their length with different colors for production of predetermined complex designs in the carpet.

40 Claims, 10 Drawing Figures

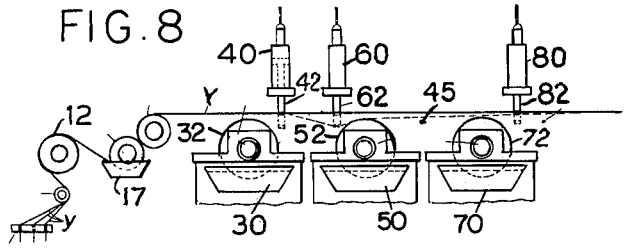
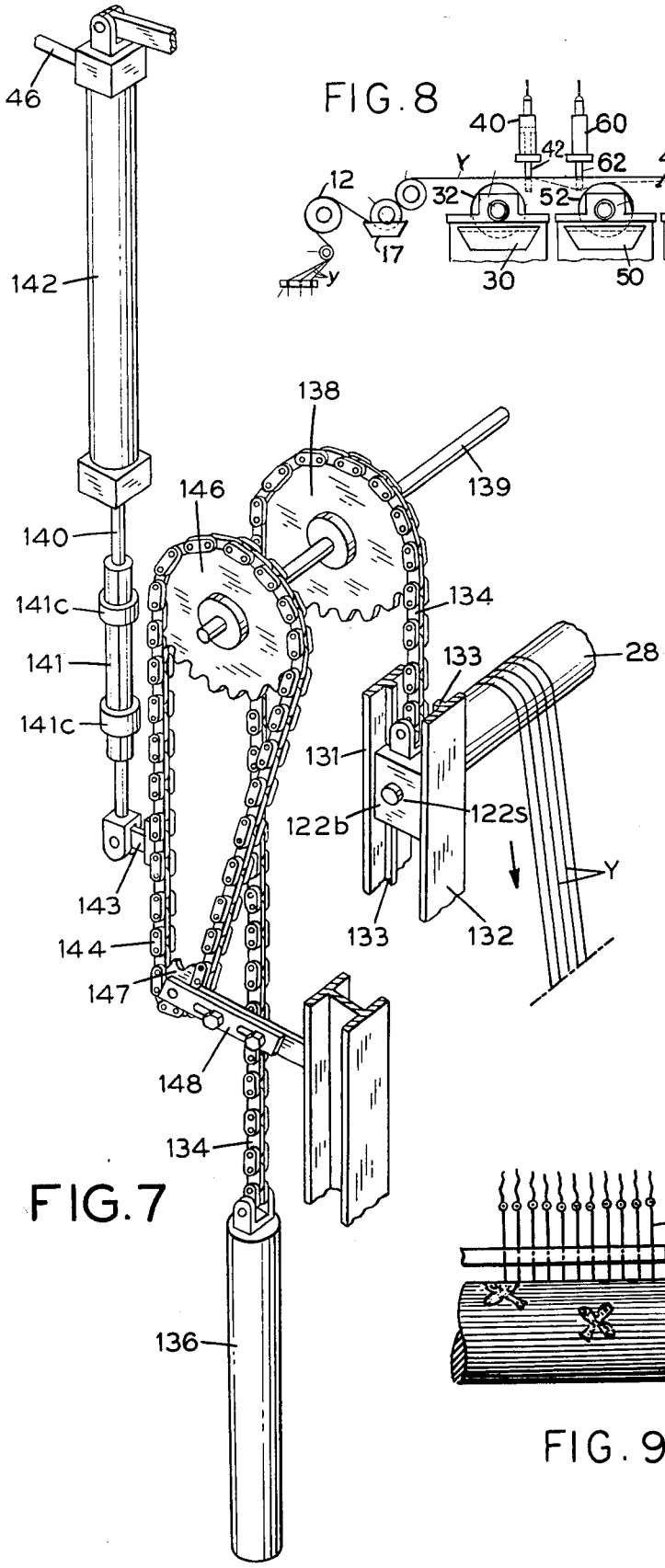
FIG. 7
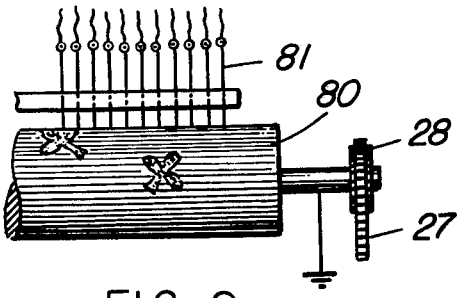
FIG. 9

YARN TENSION COMPENSATING MECHANISM

This invention relates to the manufacture of tufted carpeting and the like. More particularly it relates to improvements in the appartus for, and the method of, making tufted carpets from yarns which are drawn, in sheet form, through a dyeing machine wherein different colored dyes are applied at spaced points along the lengths of the individual yarns, after which the yarns are dried and fed to a tufting machine in which is produced tufted carpeting bearing a predetermined design.

The invention may be applied to apparatus such as is disclosed in copending application Ser. No. 603,930, filed Aug. 12, 1975 of W.C. Bartenfeld, C.A. Bryant and W.K. Newman, Sr. U.S. Pat. No. 4,015,550 wherein apparatus and a method are provided in which the yarns are dyed individually at different places along their length with different colors; and they are dried and delivered to a tufting machine and are fabricated into a carpet bearing a predetermined complex design. All this is done continuously without variation of the relationship of the yarns, one to another. More specifically, referring to said patent and to FIGS. 8 and 9 hereof wherein like reference numerals in said patent and said FIGS. refer to the same parts the individual yarns are led from a supply and around idler roll 13 and draw rolls 12 in the form of a sheet. The yarns are passed individually over a series of troughs 30, 50, 70, containing different colored dye baths in each of which is partially immersed a dye pick-up roll 32, 52, 72. In the course of this passage, by means of pneumatic cylinder and piston means 40, 60, 80, the yarns are lowered, individually by movable yarn guides 42, 62, 82, into contact with one or more or all of the pick-up rolls for predetermined limited times to cause predetermined variable lengths of the individual yarns to be individually dyed. There are separate banks of yarn guides for the individual yarn ends. Each bank extends laterally in a plane parallel to the axis of its pick-up roll above which it is supported. There is an individual guide in each bank for each yarn. The colors and lengths of the dyeing are determined by the desired pattern that is to appear as the dyed segments of yarn become loops, tufts or stitches in the carpet fabric. Pattern control means is provided to move each yarn guide individually to cause the yarn carried by it to engage a pick-up roll as shown in FIG. 9, wherein a rotating pattern drum 80 has electrically conductive fingers rubbing over conductive and nonconductive portions of a pattern laid out on the surface of the drum driven by a gear 28 and chain 27.

Subsequent to dyeing, the sheet of yarns enters a drying chamber from which the yarns are individually fed through guide tubes directly to the conventional tufting machine. In order to create a constant stretch which helps to keep the yarns aligned, the tufting machine feed rolls are synchronized with, but preferably have a slightly greater peripheral speed than the rolls that fed the yarn sheet to the dyeing portion of the apparatus.

Throughout, the positions of the individual dyed yarns relative to one another are maintained so that as they enter the tufting machine they will have the same relationship as when the dyes were applied. Thus, in the carpet fabric the colored tufts will appear in a relationship or pattern which was predetermined before the dyes were applied.

In the aforesaid method it is necessary to momentarily stop the dyeing and tufting machines from time to time for various reasons, such as the breakage of individual yarns at the tufting machine. Such breakage may result from various causes but very frequently it is due to a knot in connected ends of yarns when the yarn at the end of one creel in the supply is connected to the yarn of another creel. If the knot does not go through the yarn guides or needles of the tufting machine smoothly, it may break. Occasionally yarns break for other reasons too. In order to repair the break, it is necessary to stop the machines momentarily.

While the yarn sheet is moving the tension applied to it, to draw it through the apparatus, is quite stable notwithstanding that wetting of the yarns by application of dyes along their lengths is accompanied by stretching. Different yarns stretch different amounts when wet. So long as the yarn sheet continues to move regularly, it is subjected to uniform treatment; and any shrinkage toward original length during drying is uniform and does not produce any erratic or deleterious effects. When the machine is running, the yarn is wet when it enters the dryer. By the time it leaves the dryer, it is completely dry. Therefore, a continuous wet stretch and dry shrink condition exists at all times while the machine is running.

When the machine is stopped more than a few seconds, the whole of the part of the yarn sheet situated at that moment in in the dryer will be subjected longer than normal to heating and, as a result, the yarns while stationary, will shrink toward their original dry, i.e. before dyeing, condition. The abnormal shrinking during stoppage causes problems. Of the 40 feet or more of yarn from the beginning of application of dyes up to the tufting machine, a very large portion is in the dryer. Shrinkage of different yarns during a stoppage has been known to be from about 8 inches or less to two feet or more in practice. This shrinkage and added tension which pulls the yarn forward causing the position of the last-dyed segment to advance, thus creating an undyed or "white" segment in the yarns across the entire sheet.

THE INVENTION

The object of the apparatus provided by the invention is to control the tension of the yarns during movement from the yarn sheet entrance at the yarn draw rolls and right up to the yarn draw rolls of the tufting machine. The tension must be controlled so as to maintain the yarn stationary at the dye applicator rolls when the machine is stopped, as any movement of the yarn forward while the machine is stopped will create the above-mentioned undyed or "white" segment in the yarns, the white segment length being equal to the amount that the yarn advanced while the machine was stopped.

In order to compensate for shrinkage and the unwanted increase of tension, the present invention provides compensating mechanism which comes into play during the stoppage. This mechanism under controlled conditions gives back, gradually, yarn from an excess provided in a diverticulum or by-path along the pathway of the yarn between the drying chamber and the tufting machine. By shortening the length of the by-path gradually, under automatically and mechanically controlled conditions, the yarn shrinkage is compensated for, as will be more fully apparent as the invention is described in connection with the accompanying drawings.

Figure 2:
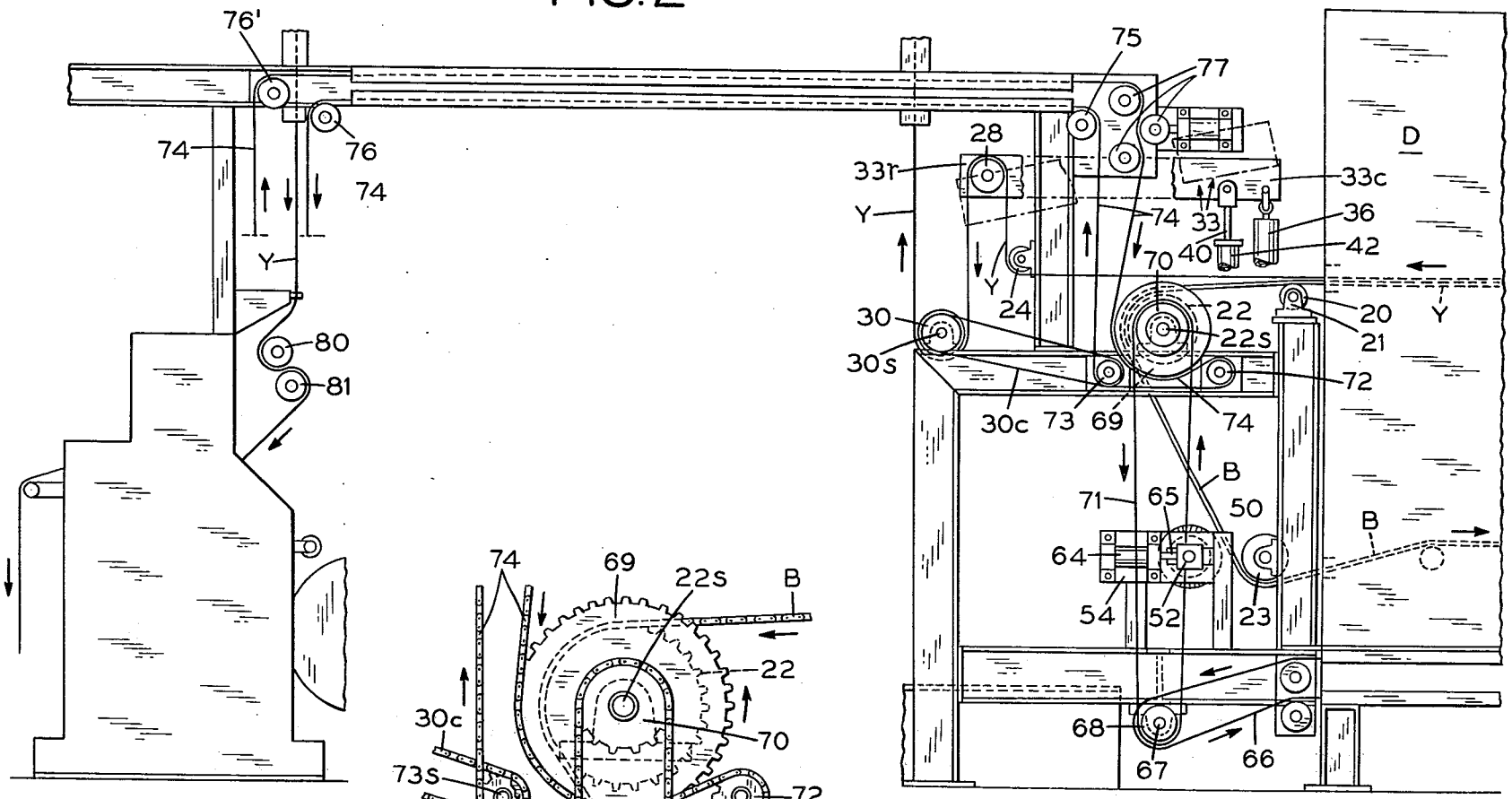
FIG. 2 is a side elevation view of the opposite side of the apparatus of FIG. 1 illustrating more particularly the driving means and showing diagrammatically the delivery of the yarn sheets to the tufting machine.
Figure 2A:
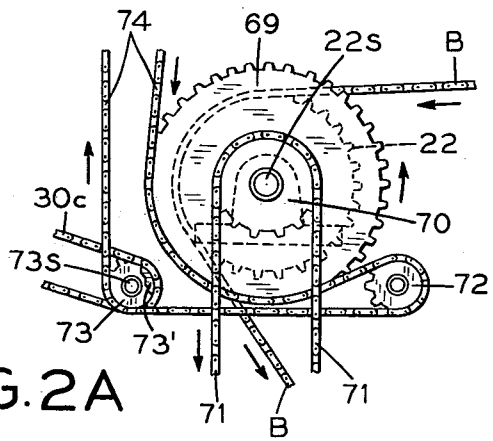

FIG. 2*a* is an enlarged detail view of the driving arrangements of FIG. 2.

Figure 1:
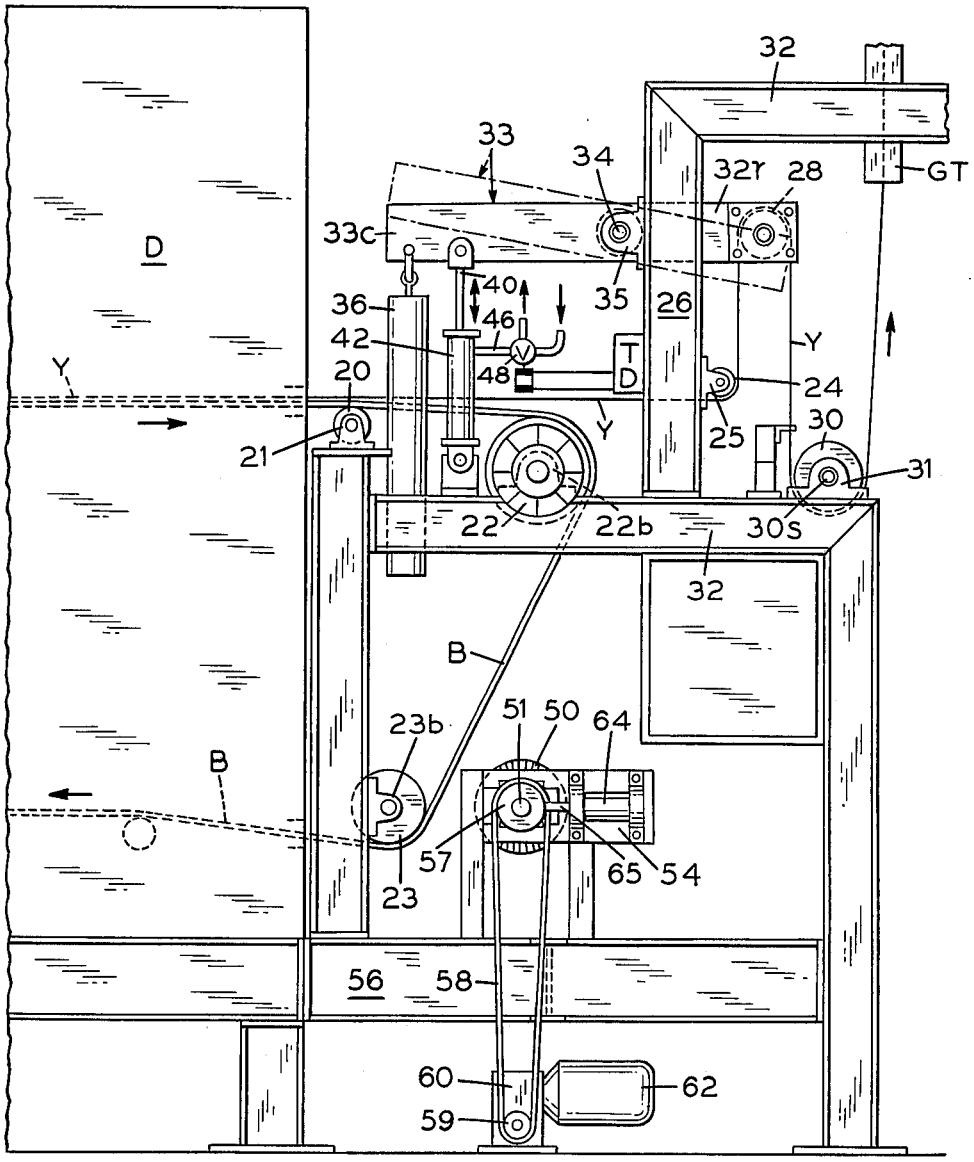
FIG. 1 is a side elevation view of compensating roll apparatus embodying one form of the invention.
Figure 3:
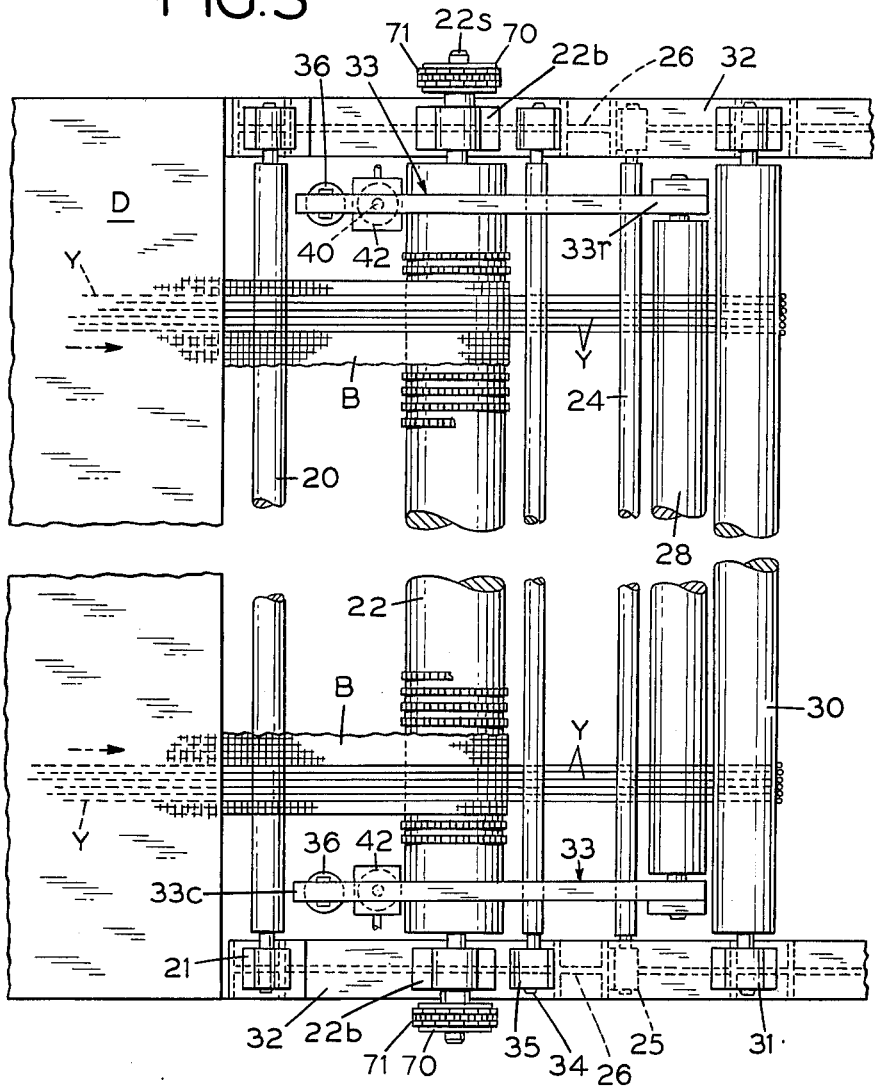

FIG. 3 is a plan view partly broken away of the apparatus as illustrated in FIG. 1.

Figure 4:
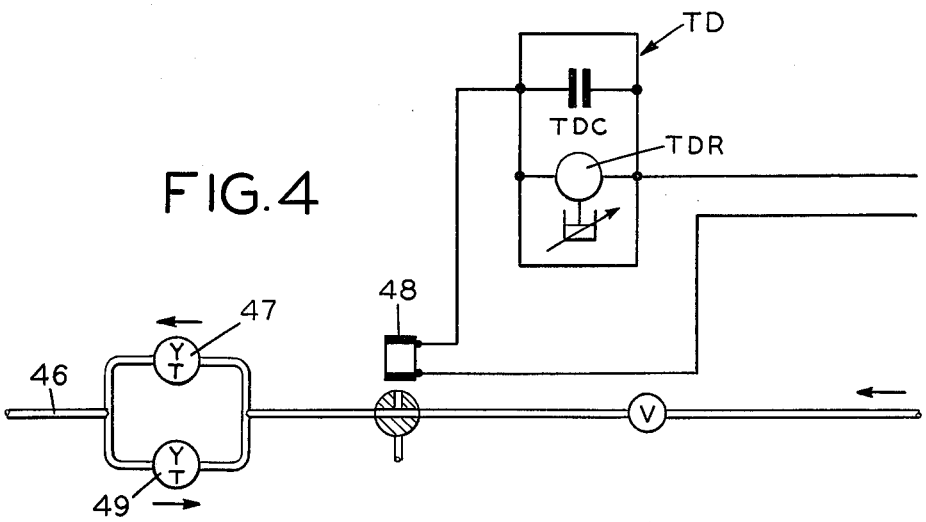

FIG. 4 is a diagram of the air supply connections and the electrical connection to the solenoid control air valve.

Figure 5:
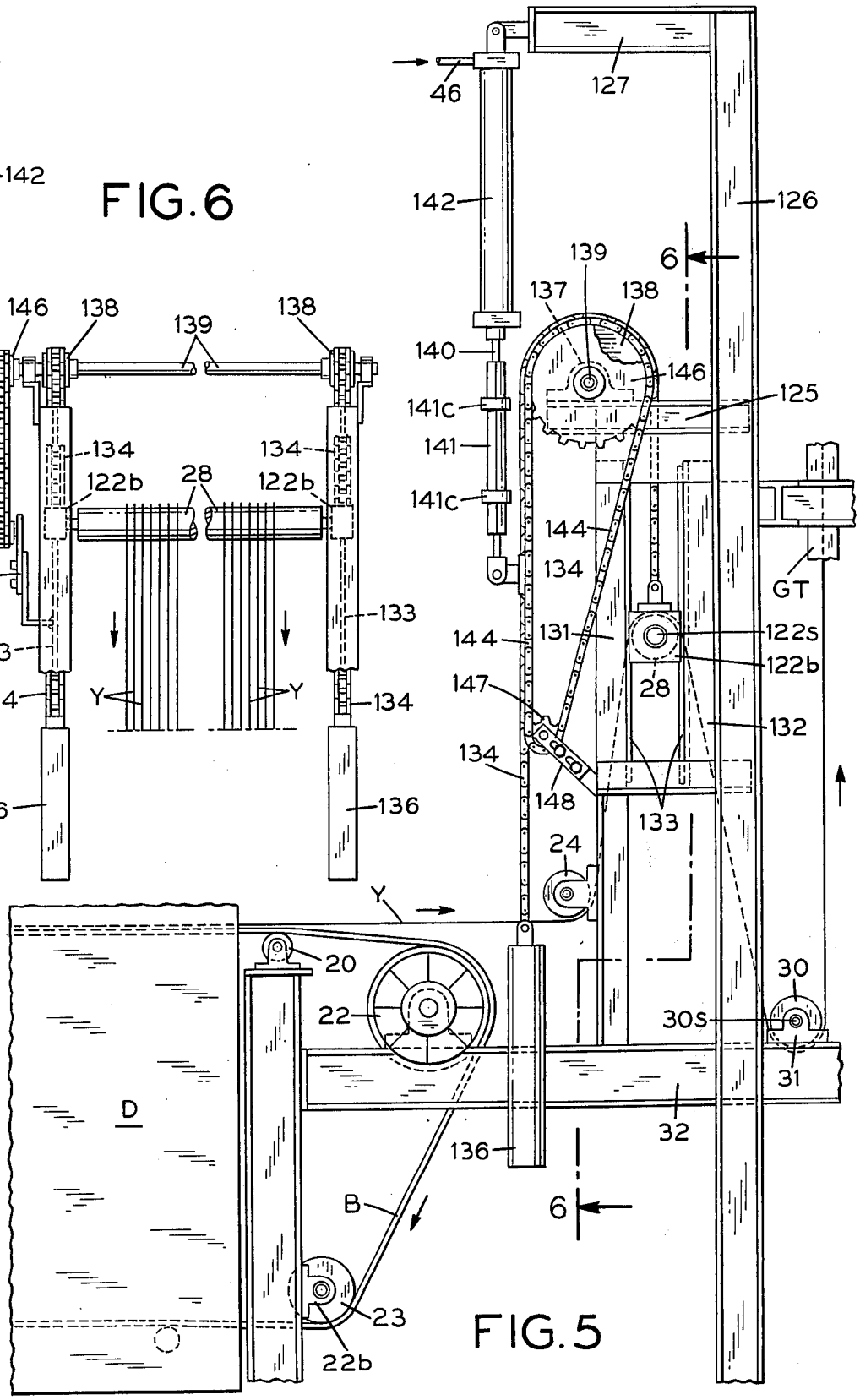

FIG. 5 is a side elevation view similar to FIG. 1 of a preferred form of the invention.

Figure 6:
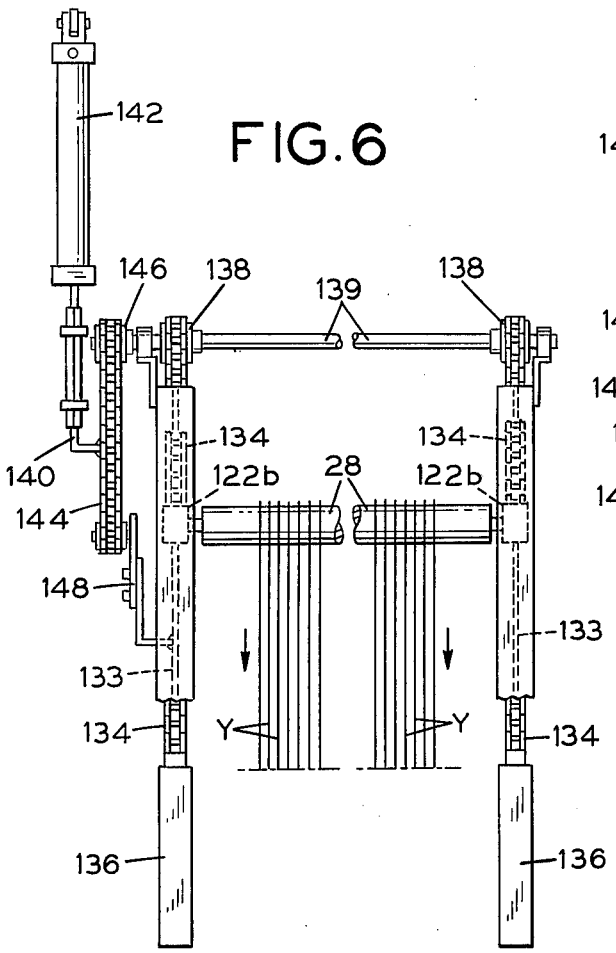

FIG. 6 is an end elevation view partly broken away showing the compensating roll, the idler roll, and the chain and sprocket connections to the air cylinder and counterweights.

FIG. 7 is a fragmentary perspective view of one end of the preferred form of invention of FIGS. 5 and 6.

FIG. 8 is an elevational view showing diagrammatically apparatus according to patent 4,015,550 in which the yarns are dyed individually at different places along their length with different colors.

FIG. 9 is a fragmentary side elevational view showing diagrammatically pattern control means of the sort disclosed in patent 4,015,550 for moving each yarn guide individually.

Referring to the drawing, the yarn sheet Y issues from the yarn drying cabinet D on a continuous chain-mesh metal conveyer belt B which passes over a small horizontal supporting roller 20. The conveyer B, moving on, passes around another larger horizontal roller 22 and then is directed downwardly and around a lower horizontal roll 23 which is supported in bearings 23*b* mounted upon vertical members of the frame. From the roll 23 the endless conveyer belt returns through the drying cabinet D to other rolls (not shown) outside and at the opposite end of the yarn drying cabinet to complete the path of the conveyer. Since the conveyer belt is preferably of continuous chain mesh, the surface of the roll 22 has axial and circumferential rows of teeth interengaging with the interstices of the belt, in order to better carry and drive the belt.

The supporting rolls 20 and 22 are journaled in bearings 21 and 22*b* at their ends which are supported in the framework of the machine at each side of the machine.

On leaving the conveyer belt B the yarn sheet Y runs horizontally and passes around a small horizontal guide roll 24 journaled at its ends in bearings 25 supported by parallel vertical beams 26 of the framework on each side of the machine. Passing around the roller 24 the yarn sheet is directed vertically upward and around a movable horizontal compensating roll 28 and thence vertically downward around a fixed horizontal roll 30 whose ends are journaled in bearings 31 supported from horizontal parallel beams 32 of the framework. From the roll 30 the yarns of the sheet pass vertically upward into a multiplicity of guide tubes GT leading to the tufting machine.

Conventional yarn guide means, such as a perforated plate or a comb, may be used before and after roll 24 and elsewhere along the path of the yarns if needed to maintain alignment of the yarns.

The movable roll 28 has its ends mounted rotatably in the ends 33*r* of two parallel pivoted lever arms 33. The arms 33 are located at each side of the machine frame and are supported at their mid-portions on a pivot shaft 34 extending transversely across the machine with its ends journaled in bearings 35 supported from the vertical beams 26.

In order to cause the pivoted arms 33 on each side of the machine to move as a unit with each other and with the roll 28, the arms are welded to the shaft 34. Thus the arms and shaft form a rigid H-shaped unit which pivots about the axis of shaft 34, and skewing or non-synchronous movement is avoided.

At the opposite ends 33*c* of the lever arms 33 from the roll 28 counterweights 36 are hung to balance the weight of the roll 28. Preferably the counterweights are slightly heavier than needed to maintain an exact balance, since it is undesirable to have the roll conditioned so that it might move down of its own volition or with any slight change in its condition. Thus the counterweights are selected to apply a slight upward bias of the compensating roll to apply a tension of a few ounces per yarn after the yarn is completely dry in the dryer and thus to maintain a "no-movement" condition, meaning no movement of the last dyed yarn segment in the dye applicator apparatus.

To compensate for the aforementioned shrinkage, a normal surplus of yarn is provided by the loop of yarn over the compensating roll between the fixed rolls 24 and 30. By the following means the giving up of yarn from the surplus is controlled and regulated by gradual lowering of the compensating roll 28. During normal running of the machine, the compensating roll 28 is held in its uppermost or an elevated position, as shown in full lines in FIG. 1. For holding the compensating roll 28 up, an air cylinder 42 is provided having a piston rod 40 extending vertically from it and connected at its upper or outer end to the end 33*c* of the pivoted lever 33. The lower end of the cylinder is supported pivotally from beam 32 of the framework by a bracket 44. An air cylinder 42 and connections may be provided at each side of the machine for each of the pivoted arms 33.

Air is admitted to the top of the cylinder 42 through an inlet pipe 46 via a three-way solenoid-controlled valve 48 and an inlet throttle valve 47 (see FIGS. 1 and 4). The air pressure on the piston (not visible) in the cylinder pushes the piston down to move and hold the end 33*r* of the pivoted lever 33 and the compensating roll 28 up. This action occurs slowly due to the throttling effect of the valve 47. When a stoppage of the machine occurs, the solenoid valve 48 is actuated to cut off the air pressure. Concurrently with the gradual release of air from the cylinder by reason of the throttling effect of an exhaust throttle valve 49, the shrinkage of the yarn sheet pulls the compensating roll 28 downwardly, gradually giving up the surplus yarn between the rolls 24 and 30.

The stroke of the piston rod may be limited by any suitable means, as hereinafter described, to vary the amount of movement of the compensating roll in accordance with the different shrinkage characteristics of different yarns.

After stoppage, the machine is started up again, concurrently the solenoid valve 48 is activated to admit air pressure again to the cylinder. This pressure gradually builds up and gradually moves the compensating roller upwardly to again provide a surplus supply which will be available for the next stoppage of the machine.

Actuation of the solenoid valve 48 is controlled by a set of supplementary contacts (not shown) which open and close simultaneously with power contacts which cause starting and stopping of the tufting machine drive motor (not shown) and feed of yarn to the dyeing apparatus. Thus operation of the compensating roll mechanism is automatically coordinated with every start and stop of the tufting machine and dyeing apparatus.

If desired, the actuation of the solenoid valve 48 may be delayed by insertion of a conventional commercially available adjustable time delay switch TD having normally operating contacts TDC and a delayed action relay TDR (see FIG. 4) placed in the electric line to the solenoid valve from the aforesaid supplementary contacts. When the stoppage is for only a few seconds duration, it may not be necessary to take advantage of the compensating means. Hence, a few seconds delay before energization of valve 48 will be advantageous.

If desired, the air cylinders 42 may be inverted in action and in position and will then be located above the pivoted lever arms 33, and will be arranged to exert a downward push instead of a downward pull on the ends 33*c* of the pivoted arms.

It is desirable to keep the mesh of the endless conveyer B clean. It tends to pick up lint. To clean the conveyer a motor driven rotary brush 50 is provided. The brush is mounted on a shaft 51 journalled in bearing 52 (FIG. 52) slidably supported above parallel horizontal frame girders 56. A pulley 57 mounted on one end of the shaft is driven by a belt 58 connecting it with another pulley 59 extending from reduction gearing 60 driven by an electric motor 62.

To move the brush toward the conveyer, a pneumatic cylinder 64 is provided having a piston rod 65 connected with the bearing 52. Air is admitted to the cylinder through a solenoid valve (not shown) which is energized simultaneously with the energization of motor 62 via a manually operated conventional pushbutton and relay arrangement. The bearing 52 is spring-biased to a position of non-engagement with the conveyor when the air cylinder is not in operation. The slidable bearing and pneumatic cylinder arrangement just described is the same at opposite sides of the machine at each end of the rotary brush.

The conveyer shaft 22*s* is driven by a sprocket 70 on its end (see FIGS. 2 and 2*a*). Around the sprocket 70 is trained a chain 71 connecting with a lower sprocket 68 on a transverse shaft 67 which in turn is driven by a sprocket and chain connection 66, to a driving motor and gearing (not shown).

The drive of the conveyer shaft 22*s* is transmitted onward to the tufting machine feed rolls by a chain 74 which passes around an idler sprocket 72 on one side of conveyer roll shaft 22*s*. Then chain 74 is trained around another idler sprocket 73 on the shaft 73*s* on the other side of the conveyer roll shaft. The shaft 73*s* also carries a sprocket 73' which meshes with a chain 30*c* connecting with a sprocket on the shaft 30*s* of fixed roll 30 to drive roll 30.

After passing around the sprocket on shaft 73*s*, chain 74 proceeds upward on its way toward the tufting machine, passing around a guide roll 75 and onward through a horizontal guideway to a guide roll 76 adjacent the tufting machine and then to sprockets (not shown) on the shafts of yarn feed rolls 80, 81 of the tufting machine.

On its return to the compensating roll mechanism, chain 74 passes around guide roll 76', through the horizontal guideway to guide rolls 77, and then back to the conveyer shaft sprocket 69. In the manner described, the yarn feed rolls 80, 81 at the tufting machine are driven in synchronism with the feed of the yarn sheet through the dyeing apparatus.

FIGS. 5 to 7 illustrate another form of invention characterized by use of a chain and sprocket arrangement for supporting the compensating roll and a chain and sprocket arrangement for supporting the counterbalancing weights, with the sprockets and their supporting shaft being fixedly connected together.

To provide for the previously mentioned larger limits of shrinkage, whilst using a more limited space, apparatus as illustrated in FIGS. 5 to 7 has been devised in order to provide the necessary large amount of vertical movement of the compensating roll. In this form of the invention the bearing blocks of the compensating roll shaft are mounted for movement vertically in guideways and are supported from chains under control of a pneumatic cylinder.

More specifically, in FIGS. 5 to 7, wherein like reference numerals represent like parts in FIGS. 1 to 4, the shaft 122*s* of the compensating roll 28 has its opposite ends journaled in bearing blocks 122*b* which are slidable vertically in parallel guide members 131, 132. The guides 131, 132 may be parallel vertical beams supported from the machine framework at their tops and bottoms with a guide surface or track 133 on each facing the other.

The bearing blocks 122*b* are shaped to engage and slide along said guide surfaces or tracks so that the compensating roll can be moved up and down. The blocks 122*b* may be of generally H-shape in horizontal cross-section with the inside surfaces of the ends of their legs slidably engaging the tracks or guides 133 and the bearing hole running lengthwise through the transverse part of the H.

To counter-balance the weight of the compensating roll 28 and bearing blocks 122*b* a counterweight 136 is provided at each end of the compensating roll shaft. Each weight is connected to its bearing block 122*b* by a chain 134 which passes over a sprocket 138 mounted fixedly on shaft 139 near its end. The shaft 139 is journaled in bearings 137 near its ends which are supported on horizontal beams 125 extending from a vertical frame member 126.

To hold the compensating roll in its uppermost position while the machine is running normally and thereby to provide a surplus of yarn, as in the form of FIGS. 1 to 4, a pneumatic cylinder 142 is supported from a horizontal beam 127 of the machine framework. The piston rod 140 of the air cylinder extends downwardly and is connected at its lower end by a bracket 143 with a vertically extending portion (the left portion in FIGS. 5–7) of a chain 144. Chain 144 is looped around an upper sprocket 146 fixedly mounted on the end of the sprocket shaft 139 and is also looped around an adjustable idler sprocket 147 below. Sprocket 147 is mounted on an adjustable arm 148 supported from a machine framework member. Arm 148 is composed of two parts which are bolted together and are movable lengthwise with respect to each other to adjust the position of the lower sprocket 147 and to locate the left portion of the chain 144 vertical and parallel to piston rod 140, and also to keep the chain 144 tight.

Since the sprockets 138, 146 are fixedly mounted upon the compensating roll shaft 139, movement of the piston rod under influence of the air pressure in the pneumatic cylinder 142 will cause the chain 144 to rotate the sprocket 146. This causes rotation of the sprocket shaft 139 and the counterweight sprocket 138. In normal operating position, the piston 140 is fully extended downwardly. In moving to that position, the shaft 139 will have been rotated counterclockwise by the rotation of the sprocket 146. This counterclockwise rotation also will have counterclockwise rotation of the sprocket 138, thereby elevating the compensating roll 28 to its uppermost position. In this position the amount of yarn looped around the compensating roll in the path between the two fixed rolls 34 and 30 will be at a maximum.

The control of the air to the cylinder 142 is the same in the form of FIGS. 5 to 7 as in the form of FIGS. 1 to 4. In other words, when the machine is running normally, the pressure of air in the cylinder 142 will have extended the piston rod 140 to its full downward extent, thereby positioning the compensating roll in its uppermost position as above explained. Automatically upon stoppage of the apparatus, the solenoid valve 48 will be operated to release air from the cylinder 142, gradually, through the throttling effect of the valve 49. The shrinkage of the yarn passing over the compensating roll will cause downward pressure; but downward movement of the compensating roll will be controlled by the retarding effect exercised upon clockwise rotation of the sprocket shaft 139 by the controlled upward movement of the air cylinder piston and piston rod 140. When the machine is started up again, the solenoid valve 48 will be opened and air will slowly be admitted to the pneumatic cylinder 142 through the throttle valve 47 to cause gradual downward movement of the piston rod 140 and counterclockwise rotation of the sprocket 146, sprocket shaft 139 and sprocket 138 to again elevate the compensating roll and provide surplus of yarn in the path of yarn from the drying apparatus to the tufting machine.

One form of means to restrict the stroke of the piston rod 140 (or rod 40 in FIGS. 1–4) for the purpose of regulating the amount of movement of the compensating roll may be a longitudinally split rigid sleeve 141 slidably and loosely mounted on the rod so that upward or retractive movement of the rod will be limited by the upper end of the rod abutting against the cylinder. Preferably the rod should not be marred or scratched by the stroke-restricting means. The sleeve can be removably secured around the piston rod by clips 141*c*, clamps or any suitable means which permit easy removal and replacement with another like sleeve of different length. It is desirable to have the sleeve parts easily replaceable to accommodate yarns of different sizes, kinds and stretch characteristic, which may require longer or shorter movements of the compensating roll.

The advantage of the form of invention illustrated in FIGS. 5 to 8 is that it requires a minimum of horizontal space for attaining the desired maximum surplus of yarn over the compensating roll. While the same amount of surplus yarn could be provided in the form of invention in FIGS. 1 to 4, a lengthening of the pivoted lever would be required which would add to the overall length of the apparatus.

From the foregoing it will be noted that in both of the illustrated forms when the machine is not running, the compensating roll 28 is down in its lowermost position. As soon as running of the machine is started, the compensating roll will start to rise gradually; and as its rise continues, a small additional tension will be imparted to the yarn sheet. The amount of tension is limited by the location of the stop or limiting means on the piston rod. As the machine starts running, the wet yarn in the dryer increases and stretches and the compensating roll rises at a regulated rate. Thus the yarn is being stretched slightly in the wet condition and it is permitted to shrink back to near original length when yarn becomes dry. In this manner, pattern distortion is avoided in addition to white segments having been avoided.

The compensating device of this invention is unique because it is power assisted and regulated in its movement to maintain the specially desired tensions at all times. It applies predetermined additional pressure gradually when the machine is in motion and releases a portion of this tension when the machine is stopped to permit a uniform tension at the dye applicator rolls at all times, and no movement of the yarn at those rolls except when the machine is running.

In summary, the compensator rolls in this invention are used to accomplish the following, taking into account the varying amounts of stretch of different yarns when wet and varying amounts of tension created upon shrinking, a. application of additional pressure, when the yarn is in motion, by an air cylinder whose pressure is controllable for one yarn size and type or another, according to need;
b. control of the distance the compensator roll may travel;
c. control of the speed of rise and fall of the compensator roll;
d. adjustable time delay control of pressure release of the air cylinders;
e. use of counterweights to maintain proper tension to permit release of the yarn rearward into the dryer to maintain the last dye segment in a stationary position at all times when the machine is stopped.

Although the invention has been described in connection with apparatus for dyeing a sheet of yarns and feeding the dyed sheet to a tufting machine, the invention is not limited to such use, but may be used in connection with any material which is subject to shrinkage or pullback in a first stage, on the material-in-process while the apparatus is stopped during passage, en route to a succeeding stage thereby increasing the tension on the material-in-process.

Many modifications within the scope of the instant invention will occur to those skilled in the art. Therefore, the invention is not limited to the precise and arrangement of parts in the preferred forms illustrated and described.

We claim:

1. In apparatus wherein stretchable material is fed from one treating stage to another, means for feeding the material through said stages in a predetermined path, movable means to divert the material from said path creating a surplus in said path during operation of the apparatus, means dependent upon continued operation of the apparatus to maintain said movable means in a certain position of predetermined diversion of said path while the apparatus is running, and means dependent upon stoppage of the apparatus exercising control of the rate of withdrawal of material from said surplus in order to compensate for shrinkage and increased tension on the material which occurs on stoppage of the apparatus.

2. Apparatus as claimed in claim 1 in which said movable means is a roll over which said material passes.

3. Apparatus as claimed in claim 2 having movable supporting means for said diverting means, the movement of said supporting means being controlled by starting and stoppage of the apparatus.

4. Apparatus as claimed in claim 1 having means to counter-balance the weight of said movable means during the withdrawal of material from said surplus.

5. Apparatus as claimed in claim 3 having means to counter-balance the weight of said movable means during the withdrawal of material from said surplus.

6. Apparatus as claimed in claim 1 in which said withdrawal controlling means includes retarding means to limit the withdrawal rate irrespective of the degree of tension increase.

7. Apparatus as claimed in claim 6 in which said retarding means also retards the restoration of said surplus to its maximum amount.

8. Apparatus as claimed in claim 6 in which said retarding means includes pneumatic pressure means, and means to throttle the inflow and outflow from said pressure means.

9. Apparatus as claimed in claim 7 in which said retarding means includes pneumatic pressure means, and means to throttle the inflow and outflow from said pressure means.

10. Apparatus as claimed in claim 1 in which said position-maintaining means and said withdrawal controlling means include pneumatic pressure means, and means to throttle the inflow and outflow from said pressure means.

11. Apparatus as claimed in claim 1 having a fixed roll around which the material passes in advance of passage around said surplus-creating means, and a second fixed roll around which said material passes subsequent to passage around said surplus-creating means.

12. Apparatus as claimed in claim 11 having driving means for one of said fixed rolls synchronized with said feeding means.

13. Apparatus as claimed in claim 12 wherein said second fixed roll is the driven roll.

14. Apparatus as claimed in claim 1 wherein said material comprises a sheet of yarns which stretch when dye is applied and which shrink upon drying, and wherein one of said stages includes drying means positioned before said surplus-creating means, said drying means causing shrinkage of said yarn upon stoppage of said apparatus causing reverse movement of the yarn sheet toward said drying means.

15. Apparatus as claimed in claim 1 having means delaying for a predetermined time the activation of said withdrawal controlling means.

16. Apparatus as claimed in claim 10 having means delaying activation of pressure release from said pneumatic means for a predetermined time after stoppage of the apparatus occurs.

17. Apparatus as claimed in claim 1 having lever means, and means supporting said diverting means on said lever means for movement of said diverting means between said certain position and withdrawal positions.

18. Apparatus as claimed in claim 10 having lever means, and means supporting said diverting means on said lever means, said pneumatic means acting on said lever means for movement of said diverting means between said certain position and withdrawal positions.

19. Apparatus as claimed in claim 6 having lever means, and means supporting said diverting means on said lever means for movement of said diverting means between said certain position and withdrawal positions.

20. Apparatus as claimed in claim 9 having lever means, and means supporting said diverting means on said lever means, said pneumatic means acting on said lever means for movement of said diverting means between said certain position and withdrawal positions.

21. Apparatus as claimed in claim 1 wherein said diverting means includes a first flexible means supporting said diverting means adjacent each end, and said withdrawal controlling means includes a second flexible means concurrently movable with said first flexible means.

22. Apparatus as claimed in claim 21 having pneumatic pressure means, and means to throttle the inflow and outflow from said pressure means, and means connecting said pressure means with said second flexible means.

23. Apparatus as claimed in claim 21 having a shaft supporting said first flexible means and said second flexible means, said first and said second flexible means being connected through said shaft for unitary movement.

24. Apparatus as claimed in claim 22 having a shaft supporting said first flexible means and said second flexible means, said first and said second flexible means being connected through said shaft for unitary movement.

25. Apparatus as claimed in claim 1 wherein said diverting means includes a chain and sprocket connection supporting said diverting means, and said withdrawal controlling means includes a second chain and sprocket connection, the sprockets of said connections being connected rigidly for unitary movement.

26. Apparatus as claimed in claim 25 including pneumatic pressure means connected to said second chain and sprocket means.

27. Apparatus as claimed in claim 22 having means to limit the stroke of said pneumatic means to accommodate different characteristics of materials being treated.

28. Apparatus as claimed in claim 8 having means to limit the stroke of said pneumatic means to accommodate different characteristics of materials being treated.

29. Apparatus as claimed in claim 4 wherein said one treating stage is a drying stage and wherein said counter-balancing means applies a bias to the compensating roll which applies a slight tension to the material when completely dry, said tension being insufficient to move the material which is located before said drying stage when the apparatus is stopped.

30. Apparatus as claimed in claim 5 wherein said one treating stage is a drying stage and wherein said counter-balancing means applies a bias to the compensating roll which applies a slight tension to the material when completely dry, said tension being insufficient to move the material which is located before said drying stage when the apparatus is stopped.

31. Apparatus as claimed in claim 21 having means to counter-balance the weight of said movable means and its said supporting means.

32. Apparatus as claimed in claim 31 wherein said one treating stage is a drying stage and wherein said counter-balancing means applies a bias to the compensating roll which applies a slight tension to the material when completely dry, said tension being insufficient to move the material which is located before said drying stage when the apparatus is stopped.

33. Apparatus for dyeing yarn ends individually at predetermined positions along their lengths and manufacturing tufted carpets therefrom to produce a predetermined multicolored complex pattern therein, the dyeing apparatus comprising means to apply different colored dyes to individual yarn ends at spaced predetermined positions along their lengths according to a pattern, a draw roll around which a sheet of yarn ends from a supply is trained and fed to said dye applying means, pattern control means controlling the application of said different dyes at said predetermined positions, a drying chamber through which the sheet of yarns passes subsequent to the last dye bath, a tufting machine having needles in which the individual yarn ends are threaded, and by which the yarn ends are needled through a backing sheet to reproduce the desired pattern, said tufting machine having at least one pair of cooperating feed rolls, means to drive said tufting machine feed rolls and said draw roll in synchronism and moveable means between said drying chamber and said tufting machine to divert said sheet of yarns from its path to said tufting machine creating a surplus in said path during operation of the apparatus, means dependent upon continued operation of the apparatus to maintain said movable means in a certain position of predetermined diversion of said path while the apparatus is running, and means dependent upon stoppage of the apparatus exercising control of the rate of withdrawal of yarn from said surplus in order to compensate for shrinkage and increased tension on the yarn which occurs on stoppage of the apparatus.

34. Apparatus as claimed in claim 33 in which said compensating means includes means to maintain the yarn without movement at the dyeing position whilst the apparatus is not running.

35. Apparatus as claimed in claim 34 in which said compensating means includes means to apply a slight tension to the yarn when completely dry, said tension being insufficient to move the yarn which is located at the dyeing position, while the apparatus is not running.

36. Apparatus as claimed in claim 33 in which said compensating means includes means to apply a slight tension to the yarn when completely dry, said tension being insufficient to move the yarn which is located at the dyeing position, while the apparatus is not running.

37. Apparatus as claimed in claim 33 in which said withdrawal controlling means includes retarding means to limit the withdrawal rate irrespective of the degree of tension increase.

38. Apparatus as claimed in claim 37 in which said retarding means also retards the restoration of said surplus to its maximum amount.

39. Apparatus as claimed in claim 37 in which said compensating means includes means to maintain the yarn without movement at the dyeing position whilst the apparatus is not running.

40. Apparatus as claimed in claim 38 in which said compensating means includes means to maintain the yarn without movement at the dyeing position whilst the apparatus is not running.

* * * * *